US005586578A

United States Patent [19]

Trout

[11] Patent Number: 5,586,578

[45] Date of Patent: Dec. 24, 1996

[54] POSITIVE SEQUENCE FLUID TRANSFER ASSEMBLY

[76] Inventor: John F. Trout, 1556 Kirkwood, Geneva, Ill. 60134

[21] Appl. No.: 493,098

[22] Filed: Jun. 21, 1995

[51] Int. Cl.[6] ..... E03B 1/00

[52] U.S. Cl. ..... 137/596.18; 137/627.5

[58] Field of Search ..... 137/627.5, 596.18, 137/869

[56] References Cited

U.S. PATENT DOCUMENTS

| | | | |
|---|---|---|---|
| 1,640,526 | 8/1927 | Bragg et al. | 91/456 X |
| 3,884,454 | 5/1975 | Passmore | 137/627.5 X |
| 4,630,523 | 12/1986 | Tersteegen | 91/454 X |
| 4,778,083 | 10/1988 | Decker | 137/869 X |
| 5,454,400 | 10/1995 | Rodgers | 137/596.18 |

*Primary Examiner*—Hoang Nguyen
*Attorney, Agent, or Firm*—John C. Albrecht

[57] ABSTRACT

A fluid transfer assembly comprises two parallel fluid transfer paths and a shared, linear path actuator for providing positive sequencing of input and output valves of both paths. Corresponding valves of the two paths share a lever assembly which is rotated between first and second positions by reciprocal movement of the liner path actuator.

10 Claims, 2 Drawing Sheets

146
141
142
145
161
163
143
162
144

1B
1A
141
123
122
124
120
121
140
143
114
144
110
113
112
155
111

113
116
152
112
114
155
151
111
115

176
177
174
178
179
171
162
178
179

174
173
171
175

POSITIVE SEQUENCE FLUID TRANSFER ASSEMBLY

TECHNICAL FIELD

Valve assemblies for transfer of fluids from an input port to an output port by way of a transfer chamber.

BACKGROUND OF THE INVENTION

There are a variety of commercial operations wherein a fluid, e.g., a resin which is available in a source volume e.g., a few gallons, is moved under a first pressure to fill a closed dispensing reservoir; and then dispensed from that reservoir to a work site under carefully controlled conditions i.e., pressure and rate of output flow. The injection of a two component epoxy resin into structural cracks of a concrete structure to effect a permanent repair of the structure is an illustrative example of such commercial operations. A dispenser which meters and mixes the two components i.e., base resin and catalyst comprises a pair of transfer assemblies for handling the two components and a common output region where the outputs of the assemblies are mixed and delivered to the work site. Such a prior art dispenser is the CD3-A Dispenser which is marketed by Lily Corporation of Aurora, Ill. Each transfer assembly comprises: an input port, an input valve, a transfer chamber, a transfer input-output port, an output valve, and an output port. The input valves of the two assemblies are positioned opened and closed by a common input valve actuator; and similarly the output valves of the two assemblies are controlled by another common output valve actuator. In the CD3-A dispenser, the actuators are operated in sequence in accordance with locally produced control signals. It is important that the input valves are fully closed before the output valves are opened; and, upon completion of the dispensing of the mixture to the work site, the output valves must fully close before the input valves are opened. If the input and output valves remain simultaneously open, an improper mixture e.g., a mixture having a higher than normal catalyst level can reach the work site.

DISCLOSURE OF THE INVENTION

In accordance with my present invention: a fluid transfer assembly comprises: an input port, an input valve, a transfer chamber, a transfer input-output port, an output valve, and an output port; first and second lever assemblies, coupled respectively to the input and output valves, for respectively adjusting the input and output valves, shared mechanical actuator means for positioning the lever assemblies in fixed transfer sequences such that the input and output ports are precluded from being in simultaneous communication with the transfer chamber, and means for controlling the actuator means.

Advantageously, the use of a single actuator assures positive sequencing of states of the input and output valves and thus eliminates any possibility of direct communication between an input port and an output port.

DETAILED DESCRIPTION

Figures 1, 1A, 1B, 1C, 1D:
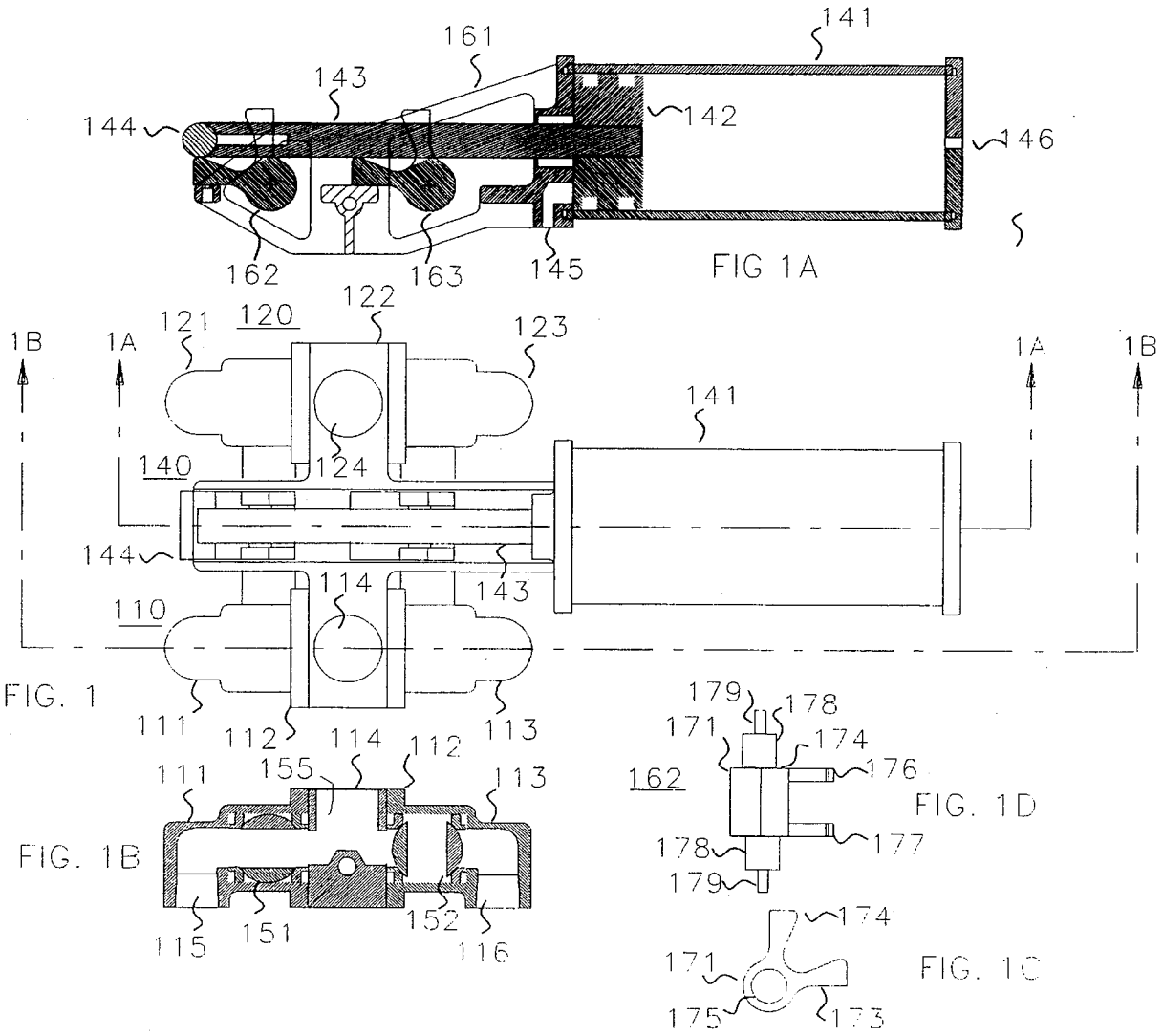
FIGS. 1, 1A and 1B are top and sectional views of a fluid transfer assembly in the "input state" of the assembly.
FIG. 1C is a top view of a lever assembly of FIG. 1.
FIG. 1D is an edge view of a lever assembly of FIG. 1.

FIG. 1 is a top-view diagram of a dual path fluid transfer assembly in accordance with my invention. The assembly of FIG. 1 comprises a first transfer path assembly 110, a second transfer path assembly 120 and a control assembly 140. The lower transfer path assembly 110 comprises an input valve module 111, a transfer module 112 and an output valve module 113. The second transfer path assembly 120 comprises an input valve module 121, a transfer module 122 and an output valve module 123.

In FIGS. 1, 1A and 1B, valves 151 and 152, levers 162 and 163 and actuator rod 143 and actuator 144 are all shown positioned in the input state of the fluid transfer assembly of FIG. 1. The cross sectional views of FIGS. 1A and 1B are schematic in form to represent the functioning of levers 162, 163 and the related valves 151 and 152. Accordingly, not all mechanical detail has been included in FIGS. 1A and 1B; and in FIG. 1A, the levers 162 and 163 are shown in full outline without regard for the presence of the actuator rod 143.

The general construction of the lever assemblies 162 and 163 is shown in FIGS. 1C and 1D. The lever 171 of FIG. 1C comprises a through hole 175 for receiving an attached shaft 178, 179 which is operatively coupled to a valve in each transfer path assembly. In the illustrative embodiment of my invention, the unitary lever 171 comprises a first lever arm 173 and a second lever arm 174 which are disposed at 90° from one and another. The surfaces of the arms 173 and 174, which are nearest to each other, provide camming surfaces for operatively engaging the operator member 144 of the actuator rod assembly. As illustrated in FIG. 1D the lever arm 174 is solid and the lever arm 173 is bifurcated to permit the actuator rod 143, as illustrated in FIG. 1, to pass between the legs 176 and 177 of FIG. 1D.

In the input state of the transfer path assemblies, the valve 151 is in the open position to permit fluid communication between input port 115 and transfer chamber in transfer assembly 112, and input-output port 114. The valves in transfer assembly 120 are similarly positioned.

The lever assembly 162 of FIG. 1A is coupled to a shaft which in turn is coupled to the valves in input valve modules 111 and 121. Similarly, lever assembly 163 of FIG. 1A is coupled to a shaft which in turn is coupled to valves in valve modules 113 and 123 of FIG. 1.

Figure 2A:
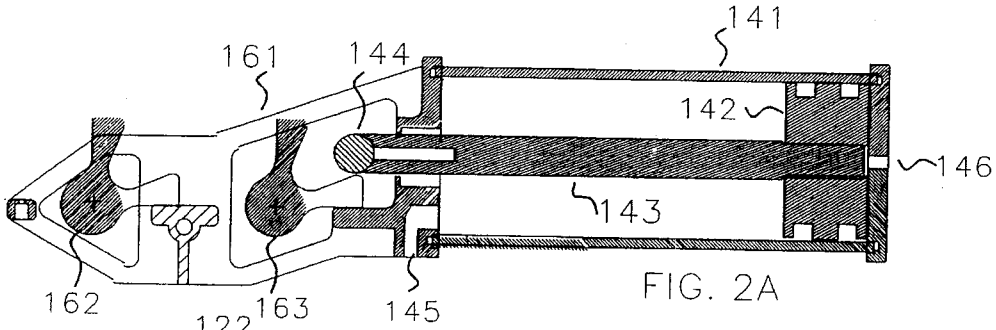
FIGS. 2, 2A and 2B are top and sectional views of a fluid transfer assembly in the "output state" of the assembly.

In FIG. 1A, lever assemblies 162 and 163 have been placed in the "input state" by movement of actuator rod 143, actuator 140, and plunger 142 from their fully withdrawn positions, as illustrated in FIG. 2A, to their fully extended positions.

Figure 2:
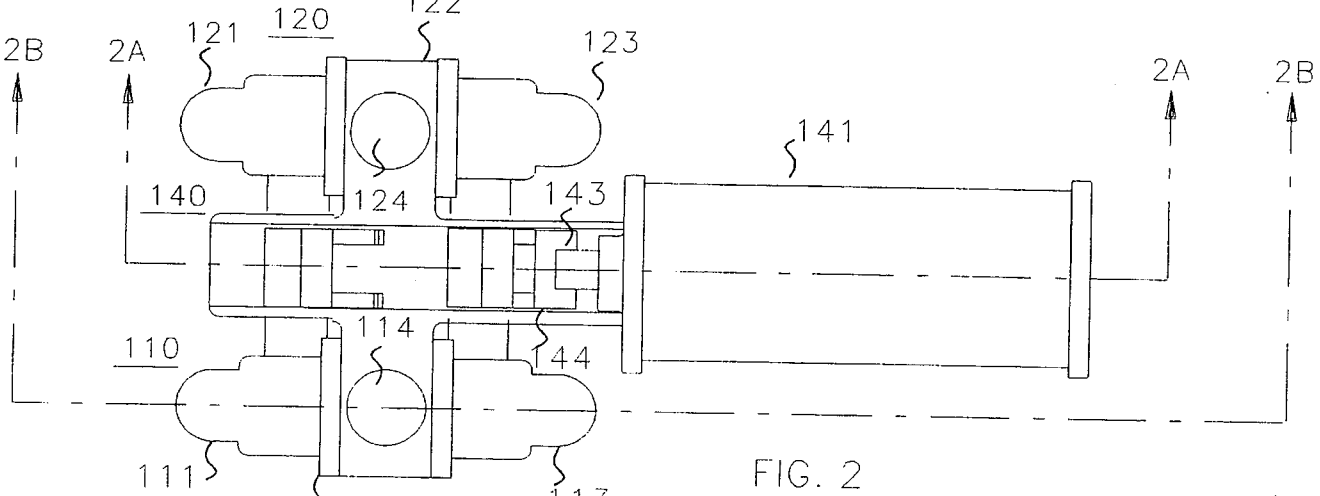
Figure 2B:
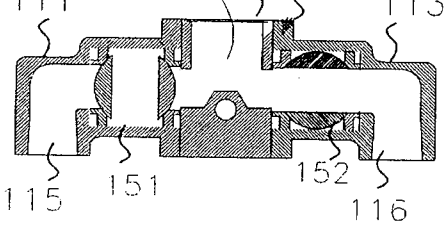

The dual path fluid transfer assembly of FIGS. 1 and 2 has two stable states, namely, the "input state" and the "output state". In the "output state", the positions of valves 151 and 152, levers 162 and 163, actuator 144, actuator rod 143 and solenoid plunger 142 are shown in FIGS. 2, 2A and 2B. The plunger 142, of solenoid 141, is selectively moved between the fully extended position shown in FIG. 1A and the fully withdrawn state shown in FIG. 2A by selectively introducing air at ports 145 and 146.

For both directions of travel of actuator arm 143 and actuator 144, input valve 151 and output valve 152 are never simultaneously open to permit communication between the input port 115 and output port 116. As the transfer assembly is cycled from the input state to the output state, valve 151 is closed and only thereafter output valve 152 is opened. Similarly as shown in FIG. 2 as the transfer assembly is cycled from the output state to the input state, valve 152 is first closed and only thereafter valve 151 is open.

In the illustrative embodiment of my invention, the actuator 144 is moved bidirectionally between the "input" and "output" states of the transfer mechanism by operation of pneumatic solenoid 141. While this arrangement is the preferred embodiment of my invention, other mechanical arrangements can be used to achieve the desired reciprocating movement of actuator 144. For example, solenoid 141 can be either an electric or hydraulic solenoid.

The invention has been described with particular attention to its preferred embodiment; however, it should be understood that variations and modifications within the spirit and scope of the invention may occur to those skilled in the art to which the invention pertains.

What is claimed is:

1. A fluid transfer assembly comprising:

at least one transfer path assembly (110) comprising: an input port (115), an input valve (151), a transfer chamber (155), a transfer input-output port (114), an output valve (152), and an output port (116); and control means (140) for adjusting said input and output valves characterized in that said control means (140) comprises first and second lever assemblies (162, 163), coupled respectively to said input and output valves (151, 152), for respectively adjusting said input and output valves (151, 152), mechanical actuator means (143, 144) for positioning said lever assemblies (162, 163) in fixed transfer sequences such that said input and output ports (115, 116) are precluded from being in simultaneous communication with said transfer chamber (155), and means (141, 142) for controlling said mechanical actuator means.

2. A fluid transfer assembly in accordance with claim 1 characterized in that said transfer sequences comprise:

an input transfer sequence in which said output valve (152) is moved to the closed position to isolate said transfer chamber (155) from said output port (116), and thereafter said input valve (151) is moved to the open position to provide fluid communication between said input port (115) and said transfer chamber (155), and an output transfer sequence in which said input valve (151) is moved to the closed position to isolate said transfer chamber (155) from said input port (115), and thereafter said output valve (152) is moved to the open position to provide fluid communication between said transfer chamber (155) and said output port (116).

3. A fluid transfer assembly in accordance with claim 1 characterized in that said mechanical actuator means (144) is arranged to move bidirectionally along a fixed path between a first, fully extended, operating position and a second, fully retracted, operating position.

4. A fluid transfer assembly in accordance with claim 3 characterized in that during said output transfer sequence, said mechanical actuator means (143, 144) is moved from said fully extended position to said fully retracted position; and during said input transfer sequence, said mechanical actuator means (143, 144) is moved from said fully retracted position to said fully extended position.

5. A fluid transfer assembly in accordance with claim 1 characterized in that said mechanical actuator means comprises: a solenoid output shaft (143) and a horizontal operating bar (144) attached, at its midpoint, to the distal end of said output shaft and running transverse to said shaft.

6. A fluid transfer assembly in accordance with claim 5 characterized in that said solenoid is air operated.

7. A fluid transfer assembly in accordance with claim 5 characterized in that each lever assembly comprises a unitary lever comprising a common pivot point (175) and a pair of arms (173, 174) disposed at approximately 90 degrees from one and the other about said pivot point; and output means (178, 179) centered on said pivot point for coupling said lever assembly to one of said at least one valve.

8. A fluid transfer assembly in accordance with claim 7 characterized in that the nearest adjacent surfaces of said arms (173, 174) each comprise camming surfaces for engaging said operating bar.

9. A fluid transfer assembly in accordance with claim 7 characterized in that the major surface of one arm (133) of each lever assembly is bifurcated to permit said solenoid output shaft to pass therethrough while permitting said horizontal operating bar to operatively engage said arm.

10. A fluid transfer assembly in accordance with claim 1 characterized in that said fluid transfer assembly comprises two isolated transfer path assemblies (110, 120); and said control means (140) is common to said path assemblies.

* * * * *